US007861488B2

(12) United States Patent
Giles et al.

(10) Patent No.: US 7,861,488 B2
(45) Date of Patent: Jan. 4, 2011

(54) CORRUGATED DECKING FLOORING SYSTEM

(75) Inventors: Patrick Henry Giles, Anoka, MN (US); Clarence Curtis McCorsley, III, Ashville, NC (US)

(73) Assignees: Maxxon Corporation, Hamel, MN (US); Colbond Inc., Enka, NC (US)

( * ) Notice: Subject to any disclaimer, the term of this patent is extended or adjusted under 35 U.S.C. 154(b) by 0 days.

(21) Appl. No.: 12/126,537

(22) Filed: May 23, 2008

(65) Prior Publication Data

US 2008/0289292 A1 Nov. 27, 2008

Related U.S. Application Data

(60) Provisional application No. 60/939,749, filed on May 23, 2007.

(51) Int. Cl.
*E04C 2/54* (2006.01)
*E04C 2/42* (2006.01)
*E04C 5/04* (2006.01)

(52) U.S. Cl. ..... 52/783.11; 52/671; 52/674

(58) Field of Classification Search ..... 52/783.11, 52/671, 674, 309.1, 537, 630
See application file for complete search history.

(56) References Cited

U.S. PATENT DOCUMENTS

| | | | | | |
|---|---|---|---|---|---|
| 4,186,535 | A * | 2/1980 | Morton | 52/250 |
| 4,206,267 | A * | 6/1980 | Jungbluth | 428/623 |
| 4,593,507 | A * | 6/1986 | Hartman | 52/220.4 |
| 4,677,800 | A | 7/1987 | Roodvoets | |
| 4,962,622 | A * | 10/1990 | Albrecht et al. | 52/630 |
| 5,299,405 | A * | 4/1994 | Thompson | 52/783.11 |
| 5,399,406 | A * | 3/1995 | Matsuo et al. | 428/57 |
| 5,612,111 | A * | 3/1997 | Lin | 428/71 |
| 5,842,315 | A * | 12/1998 | Lin | 52/309.9 |
| 6,324,812 | B1 * | 12/2001 | Drya-Lisiecka | 52/783.11 |
| 6,745,531 | B1 * | 6/2004 | Egan | 52/302.1 |
| 7,168,221 | B2 | 1/2007 | Hunter, Jr. | |
| 7,454,876 | B2 * | 11/2008 | Kelly | 52/746.11 |
| 2002/0088199 | A1 * | 7/2002 | Linn | 52/745.19 |
| 2003/0041547 | A1 * | 3/2003 | Gosselin | 52/630 |
| 2006/0053702 | A1 | 3/2006 | Kelly | |
| 2006/0254207 | A1 | 11/2006 | Mulligan | |
| 2007/0000198 | A1 * | 1/2007 | Payne et al. | 52/414 |
| 2008/0289292 | A1 * | 11/2008 | Giles et al. | 52/783.11 |

FOREIGN PATENT DOCUMENTS

| | | |
|---|---|---|
| DE | 19512422 A1 | 10/1996 |
| FR | 1299793 | 6/1962 |
| GB | 2191797 A | 12/1987 |

OTHER PUBLICATIONS

International Search Report of PCT/US2008/064708, 7 pages dated Sep. 29, 2008.

* cited by examiner

*Primary Examiner*—Richard E Chilcot, Jr.
*Assistant Examiner*—Andrew J Triggs
(74) *Attorney, Agent, or Firm*—Fredrikson & Byron, P.A.

(57) ABSTRACT

The invention includes a corrugated decking flooring system. The corrugated decking flooring system can include a corrugated deck having at least two flutes and a trough between the flutes. A sound insulation layer generally conformal with both the flutes and the troughs of the corrugated deck can be provided. An underlayment layer can be provided over the sound insulation layer.

18 Claims, 8 Drawing Sheets

CORRUGATED DECKING FLOORING SYSTEM

RELATED APPLICATIONS

This application claims priority to U.S. Provisional Application Ser. No. 60/939,749, titled Corrugated Decking Flooring System, filed May 23, 2007, the contents of which are hereby incorporated by reference.

FIELD OF THE INVENTION

The invention generally relates to corrugated decking flooring systems.

BACKGROUND OF THE INVENTION

Corrugated decking (e.g., corrugated metal decking) is increasingly utilized instead of plywood and oriented strand board (OSB) in the construction of residential and commercial buildings. Such decking is useful for providing strength and increased mold and fire resistance. Unfortunately, metal decking has poor sound transmitting characteristics.

SUMMARY OF THE INVENTION

Embodiments of the invention provide a corrugated decking (e.g., corrugated metal decking) flooring system. The corrugated metal flooring system can include a corrugated metal deck having at least two flutes and a trough between the flutes. A sound insulation layer may be provided. In some embodiments, the sound insulation layer generally conforms to both the flutes and the troughs of the corrugated metal deck. An underlayment layer can be provided over the sound insulation layer. Other layers and finished floor product can be placed over the underlayment layer. Embodiments of the invention also include a sound insulation layer and methods of making and using such a corrugated decking flooring system and sound insulation layer.

DETAILED DESCRIPTION OF THE INVENTION

Figure 1:
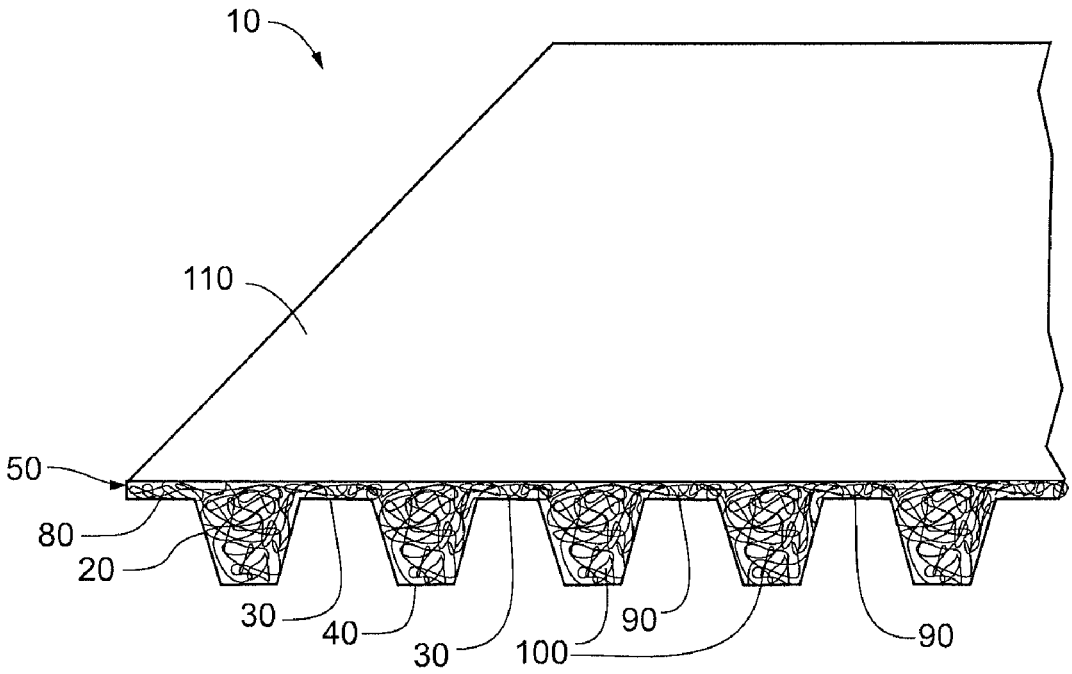
FIG. 1 shows a perspective view of a corrugated deck and sound insulation layer in accordance with an embodiment of the invention.

For the purpose of promoting an understanding of the principles of the invention, reference will now be made to the embodiments illustrated, not necessarily to scale, in the drawing and specific language will be used to describe the same. It will, nevertheless, be understood that no limitation of the scope of the invention is thereby intended; any alterations and further modifications of the described or illustrated embodiments, and any further applications of the principles of the invention as illustrated therein, are contemplated as would normally occur to one skilled in the art to which the invention relates.

As shown in FIG. 1, embodiments of the invention include a corrugated decking (e.g., corrugated metal decking) flooring system 10 for use in residential and commercial buildings. The corrugated metal flooring system can include a corrugated metal deck 20 having alternating flutes 30 and troughs 40, the deck including at least two flutes 30 and a trough 40 between the flutes. A sound insulation layer 50 may be provided. In some embodiments, the sound insulation layer generally conforms to both the flutes and the troughs of the corrugated metal deck. In certain embodiments, such as the embodiment shown in FIG. 2, an underlayment layer 60 can be provided over the sound insulation layer. Other layers and finished floor product can be placed over the underlayment layer.

Figure 2:
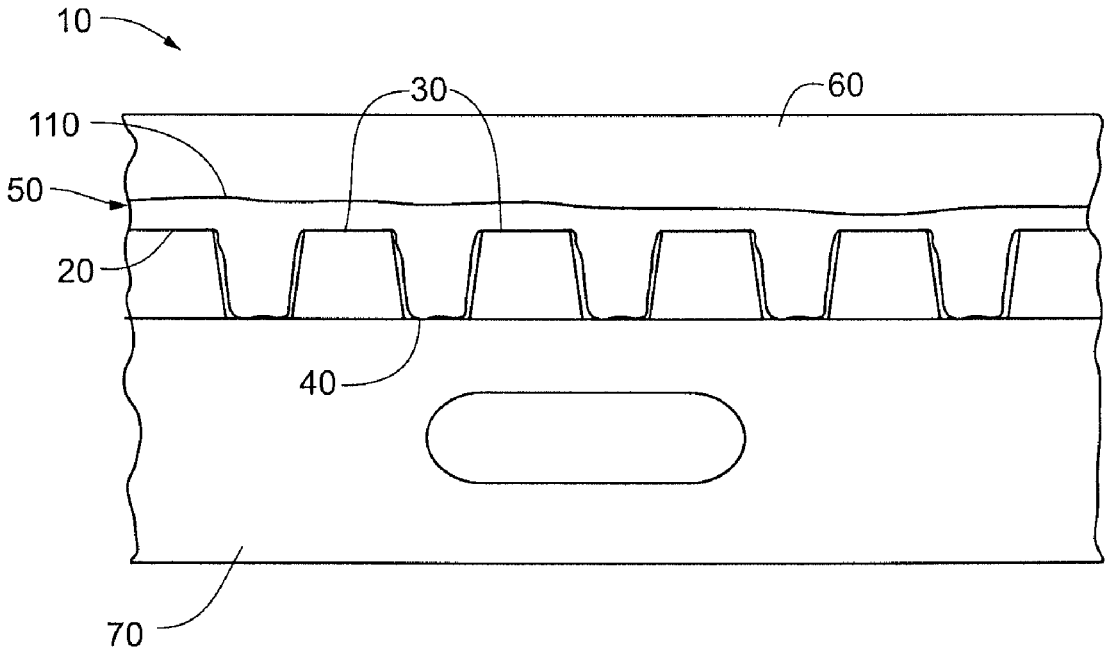
FIG. 2 shows a front schematic view of a corrugated deck flooring system in accordance with an embodiment of the invention.
Figure 3:
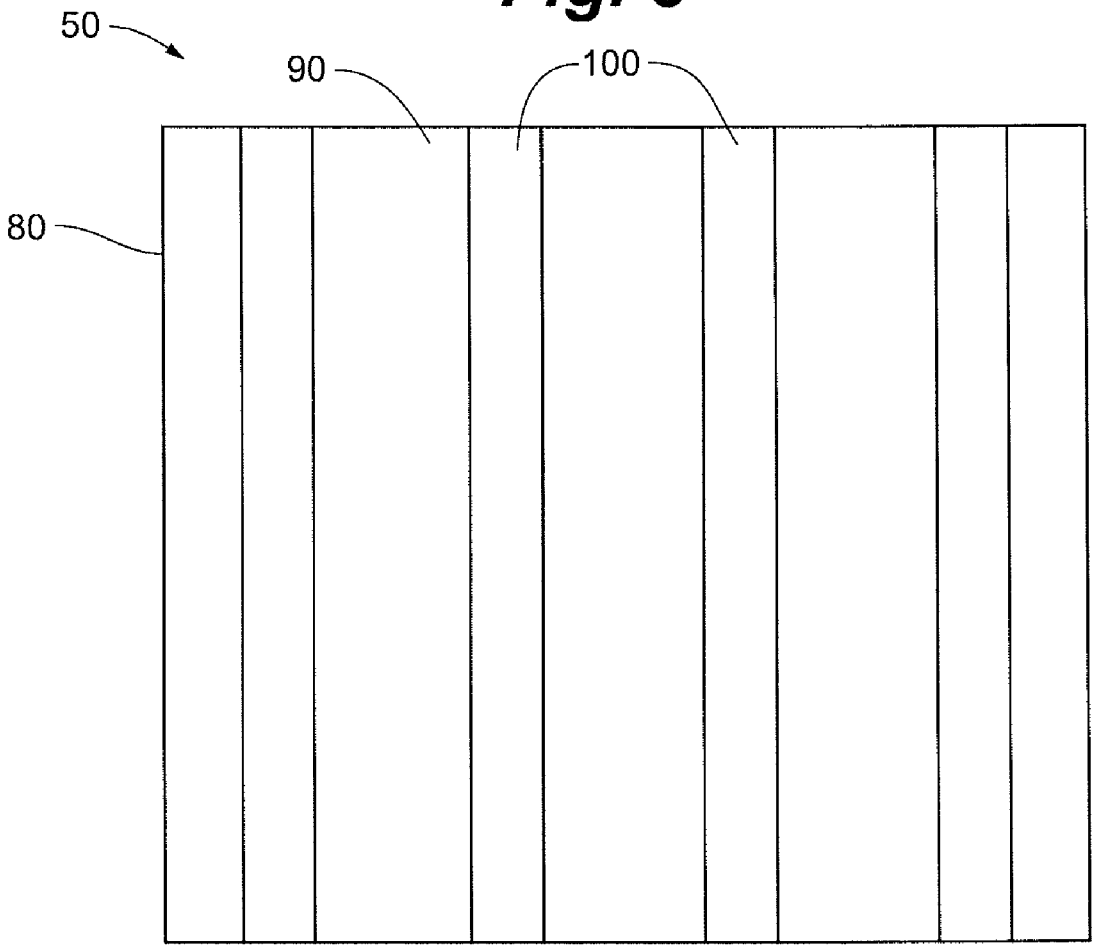
FIG. 3 shows a bottom schematic view of a sound insulation layer in accordance with an embodiment of the invention.
Figure 5:
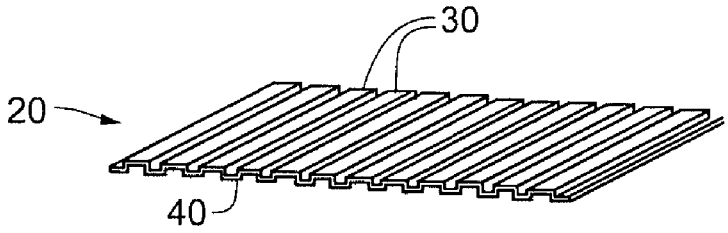
FIG. 5 shows a perspective view of a corrugated deck useful with embodiments of the invention.
Figure 6:
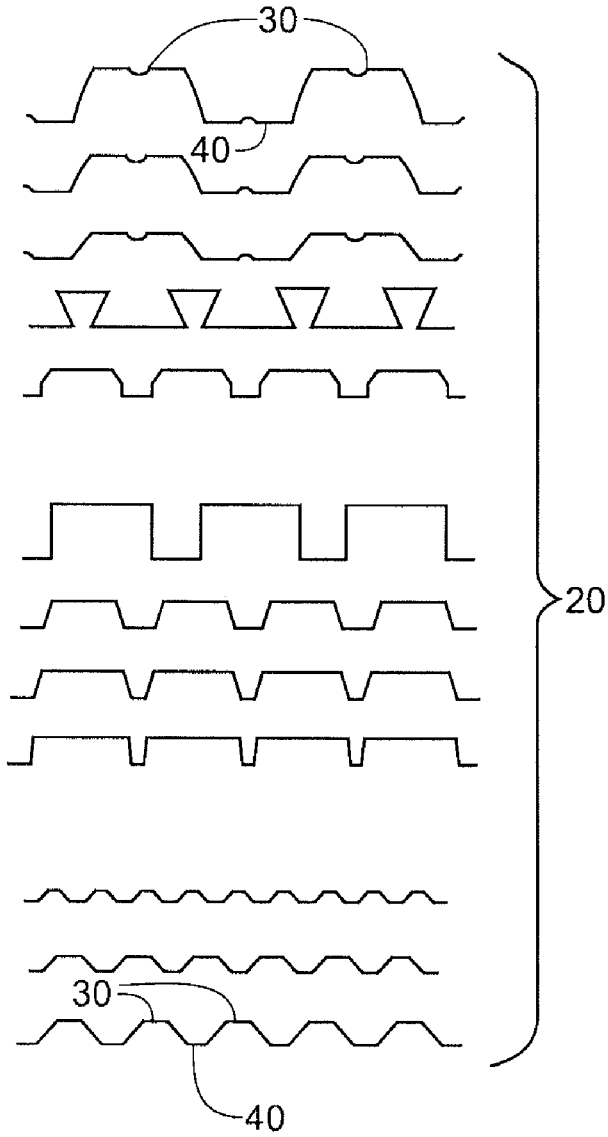
FIG. 6 shows front schematic plan views of various corrugated deck profiles useful with embodiments of the invention.

The corrugated decking 20, which replaces the generally planar plywood or OSB used in traditional wood construction, can include any corrugated shape. For example, the shape can include a flute to flute (e.g., on center) distance of about 1 inch to about 5 inches (e.g., about 2.5 inches) (about 2.5 centimeters (cm) to about 12.7 cm (e.g., about 6.35 cm)), and a flute depth of about 0.25 inch to about 3 inches (e.g., about $9/16^{th}$ inch) (about 0.6 cm to about 7.6 cm (e.g., about 1.4 cm)). Further, generally ramped surfaces connecting the flutes and troughs can have any ramp angle, and the transition between the ramp surface and the flute or trough can be as sharp or gradual as desired. The corrugations may have a generally sinusoidal shape, but the outermost extend of the troughs and/or the flutes may include a planar shape. Corrugated decking can comprise a metal, and any metal can be used (e.g., steel). In such embodiments the steel decking can have a thickness of about 0.05 inches to about 0.5 inches (about 0.013 cm to about 1.3 cm). As shown in FIG. 2, the corrugated metal deck can be supported by a joist 70, such as a steel joist. Various embodiments of corrugated decking profiles that can be utilized with the invention are show in FIGS. 5 and 6.

As shown in FIGS. 1-4, a sound insulation layer 50 can be provided to improve (e.g., dampen) the sound transmitting characteristics of the corrugated metal decking. Some embodiments of the invention include a sound insulation layer that generally conforms to both the flutes and the troughs of the corrugated metal deck. In some embodiments, the sound insulation layer includes a voluminous core 80 having a flute resting portion 90 and a trough resting portion 100, with a backing layer 110 attached to the surface opposite the surface that sits in apposition to the corrugated decking. The voluminous core 80 assists in providing sound damping by entrapping many small air spaces and having good sound insulating properties. The flute resting portion can have a thickness of about ¼ inch to about ½ inch (e.g., about ⅜ inch) (about 0.64 cm to about 1.3 cm (e.g., about 0.95 cm)), and the trough resting portion can have a thickness of about ¼ inch to about 3 inches (e.g., about 9/16 inch) (about 0.64 cm to about 7.6 cm (e.g., about 1.4 cm)). Such embodiments have a generally corrugated first surface that sits in apposition to the corrugated decking, and a generally planar second surface that is useful for supporting an underlayment layer, as discussed further herein.

The voluminous core can comprise a plurality of fused entangle filaments (i.e., entangled filaments generally fused at their intersections) forming a three-dimensional matrix. In some embodiments, the voluminous core has fused entangle filaments with an average diameter of about 250 microns to about 1000 microns (e.g., about 350 microns). In certain embodiments, the flute resting portion includes a plurality of fused entangle filaments having a first average diameter (e.g., about 300 microns) and the trough resting portion includes a plurality of fused entangle filaments having a second average diameter (e.g., about 500 microns), the second average diameter being greater than the first average diameter.

Figure 4:
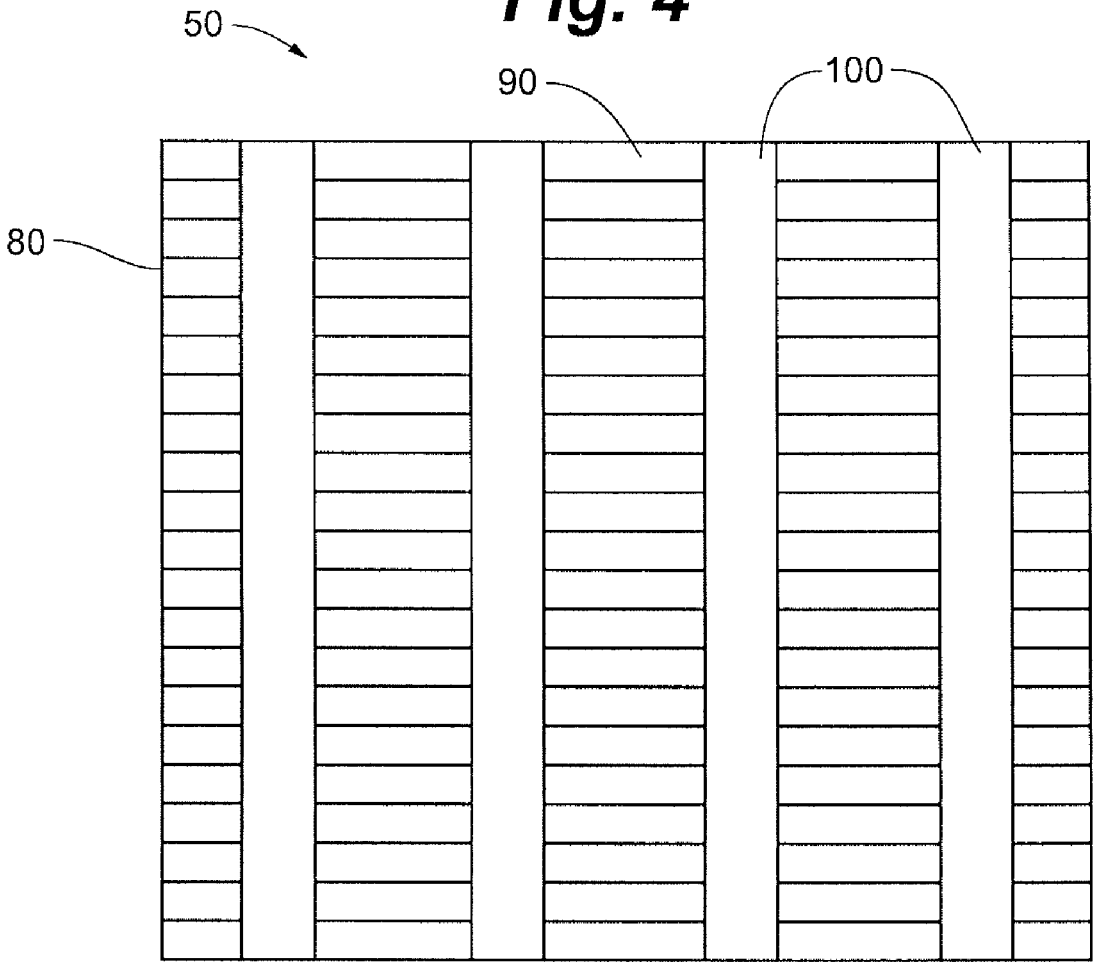
FIG. 4 shows a bottom schematic view of a sound insulation layer in accordance with another embodiment of the invention.

As shown in FIG. 4, in some embodiments the flute resting portion 90 includes a plurality of fused entangle filaments (individual fused entangle filaments are not shown in FIG. 4) having a generally corrugated shape, the corrugations proceeding in a first direction. In such embodiments, the trough resting portion 100 can have a longitudinal axis generally normal to the first direction.

Figure 7:
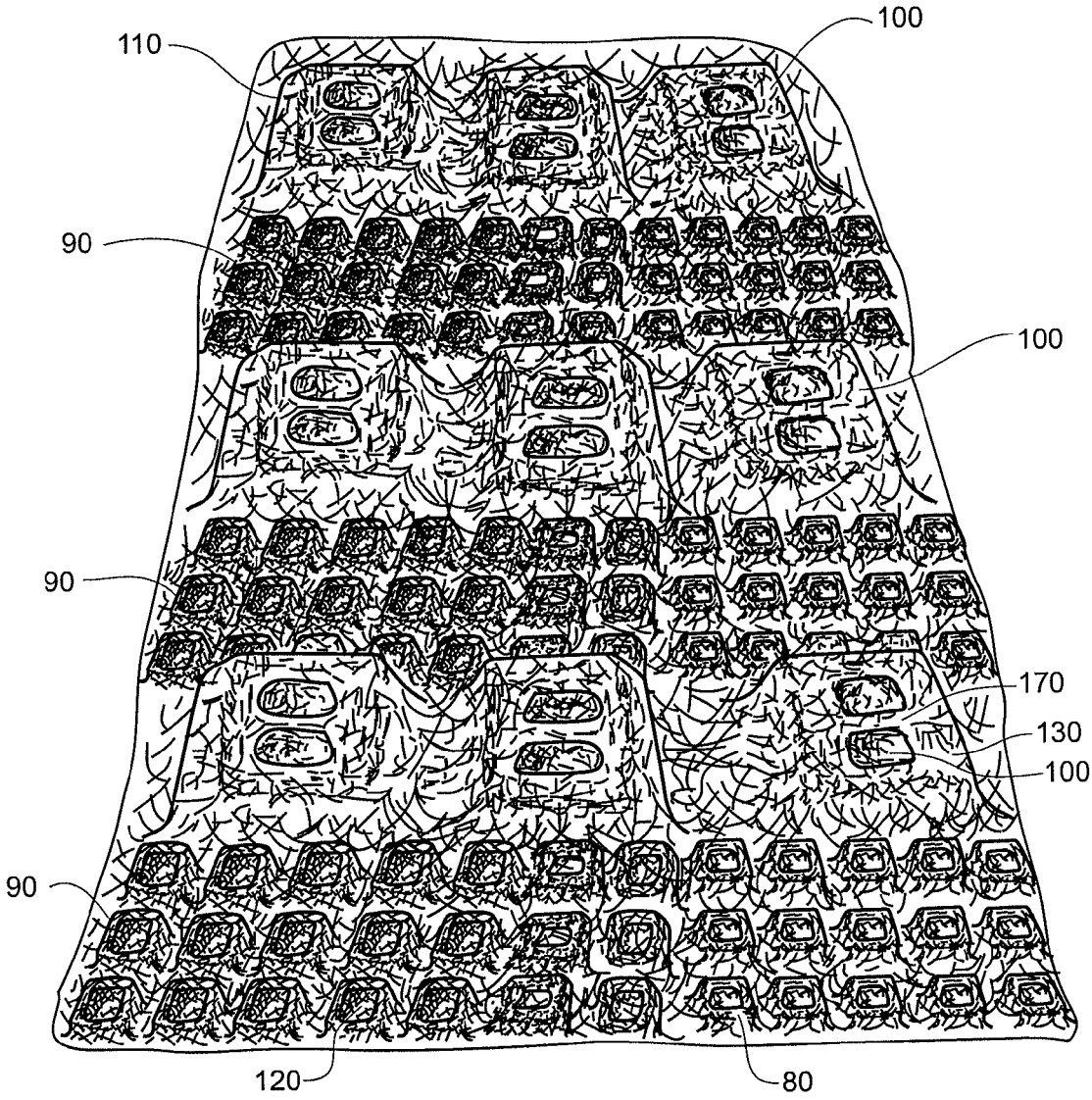
FIG. 7 shows a bottom perspective view of a sound insulation layer in accordance with an embodiment of the invention.

As shown in FIG. 7, in some embodiments the flute resting portion 90 can include relatively small features 120 formed of fused entangle filaments. The trough resting portion 100 can also include a series of relatively large features 130 formed of fused entangle filaments. As shown, one or more relatively large features 130 can also be separated by additional relatively small features included within the trough resting portion 100. In some embodiments, viewed from the bottom (i.e., the surface which will sit in apposition to the corrugated decking) the relatively small features 120 take the form of pyramid shaped recesses with a plateau bottom. In some embodiments, the relatively small features 120 are about 0.25 inches to about 0.5 inches (about ⅜ inches) (about 0.64 cm to about 1.3 cm (about 0.95 cm)) deep, have a plateau bottom of about 0.05 inches square to about 0.5 inches square (about 0.16 inches square) (about 0.13 cm square to about 1.3 cm square) (about 0.4 cm square)), and are spaced about 0.1 inches to about 1 inch (about 0.5 inches) (about 0.25 cm to about 2.54 cm (about 1.27 cm)) center to center. The relatively large features 130 can also take the form of a pyramid shaped recess with a plateau bottom. In some embodiments, the relatively large features 130 have a total height of about 0.5 inches to about 1.5 inches (about 0.95 inches) (about 1.3 cm to about 3.8 cm (about 2.4 cm)), a plateau bottom of about 0.1 inches square to about 0.75 inches square (about 0.24 inches square) (about 0.25 cm square to about 1.9 cm square (about 0.6 cm square)), and are spaced about 0.25 inches to about 1.25 inches (about 0.75 inches) (about 0.64 cm to about 3.2 cm (about 1.9 cm)) center to center. In certain embodiments, one or more of the relatively large features 130 may be disposed within a raised section 170 such that the plateau bottoms of the relatively large features and the plateau bottoms of the relatively small features reside in the same plane. Such a plane provides a series of contact points in the same plane useful for attaching a backing layer, and may be considered a "planar surface" for purposes of this disclosure.

In such embodiments, the voluminous core 80 shape is designed to match the corrugated decking such that the flute resting portion is positioned above the flute of the deck by about 0.25 inches to about 0.5 inches (about ⅜ inch) (about 0.64 cm to about 1.3 cm (about 0.95 cm)). The flute resting may have the backing layer 110 attached. At installation the sound insulation layer will lay flat on top (backing layer side) and the backing layer will be positioned about 0.25 inches to about 0.5 inches (about ⅜ inch) (about 0.64 cm to about 1.3 cm (about 0.95 cm)) above the high point of the flute while the lower side of the voluminous core will generally fill the troughs of a corrugated deck.

The voluminous core 80 can include any material useful for damping sound that has suitable resiliency and stiffness. In some embodiments, the voluminous core comprises a polymer. Examples of suitable polymers include nylon (e.g., nylon 6), polypropylene, polyethylene (including high density polyethylene, and polyethylene terephthalate), and poly lactic acid. Examples of suitable examples of nylon 6 have a relative viscosity (1% polymer solution in $H_2SO_4$ of 96% at 20 degrees Celsius) of about 2.0 to about 3.2 (e.g., about 2.4 to about 2.8). In some embodiments, the nylon 6 can be dried to about 0 to about 2000 PPM (e.g., about 60 to about 200 PPM) for optimum processing conditions. The basis weight of the voluminous core can be about 15 ounces per square yard to about 25 ounces per square yard (e.g., about 20 ounces per square yard) (about 508 grams per square meter to about 847 grams per square meter (e.g., about 678 grams per square meter)).

In some embodiments, a backing layer 110 attached to the voluminous core 80 is provided. The backing layer may provide a generally waterproof barrier between the voluminous core and the underlayment layer 60. The backing layer may also provide support to the underlayment after it solidifies. Additionally, the backing layer may provide a tie point at each plateau of the voluminous core 80 to provide additional structural support of the voluminous core and to reduce movement. In some embodiments, the backing layer can include a nonwoven fabric made from any material, such as polyester. Additional layers can be provided along with the backing layer, if desired. An example of such an additional layer includes waterproof layers. A waterproof layer may be useful to prevent water from an underlayment layer in the flooring system to pool in the decking after the underlayment layer is applied and before it cures. In some embodiments, the backing layer can include three laminated layers. The outside layers can include polyester filaments and the inner layer can include a polymer film such as polyethylene, to provide a waterproof layer. A specific example of a suitable backing layer is SENW WBF-80 Nonwoven Laminate from Southeast Nonwovens, Inc., Clover, S.C. The backing layer may have a basis weight of about 60 grams per square meter to about 100 grams per square meter (e.g., about 80 grams per square meter).

Embodiments of the sound insulation layer 50 are useful for controlling sound in construction utilizing corrugated decking (e.g., corrugated metal decking). In general, there are two sound control standards that govern sound control testing for buildings; the Sound Transmission Class (STC), governed by ASTM Standards E 413 and E 90, and the Impact Insulation Class (IIC), governed by ASTM Standards E 989 and E 492. Generally the STC standards relate to airborne sound that travels from air through the floor structure, and the IIC standards relate to structure borne noises that propagate through the floor structure. For both classes, relevant International Building Code (IBC), Uniform Building Code (UBC), and/or local building code standards require a minimum class of 50 for floors used in construction where people may be on more than one level of the structure. In some embodiments of the invention, the inclusion of any of the various embodiments of sound insulation layers discussed herein to a flooring system will allow the flooring system to achieve a STC equal to or greater than 50 and an IIC equal to or greater than 50. In some embodiments of the invention, the inclusion of any of the various embodiments of sound insulation layers discussed herein to a flooring system will increase the STC and the IIC of the flooring system by more than about 20 rating points compared to the same flooring system without such a sound insulation layer. Accordingly, inclusion of the embodiments of the sound insulation layers discussed herein allows a flooring system that would otherwise fail the relevant IBC, UBC and local code sound control tests to pass such tests.

Embodiments of the invention also include a method of making a sound insulation layer 50 for a corrugated metal flooring system. The method can include the steps of providing a backing layer 110 and attaching a voluminous core 80 to the backing layer. In some embodiments, the voluminous core with both flute resting portions and trough resting portions is extruded using an extruder. In alternative embodiments, the trough resting portion and the flute resting portion are extruded separately and attached, such as with adhesive, to form the voluminous core.

The sound insulating layer 50 can be made by any suitable method. In some embodiments the filaments of the voluminous core 80 are produced by extruding molten polymer through a spinnerette. The thickness of the sound insulating layer, and the depth, thickness and spacing of the trough conforming portions 100 can be produced and controlled by depositing molten polymer onto an adjustable three dimensional wave belt having a configuration matching, to an appropriate extent, the configuration of the corrugated decking. The backing layer 110 can be attached to the voluminous core by any suitable method such as molten bonding, and can be chemically and/or mechanically attached.

Figure 8:
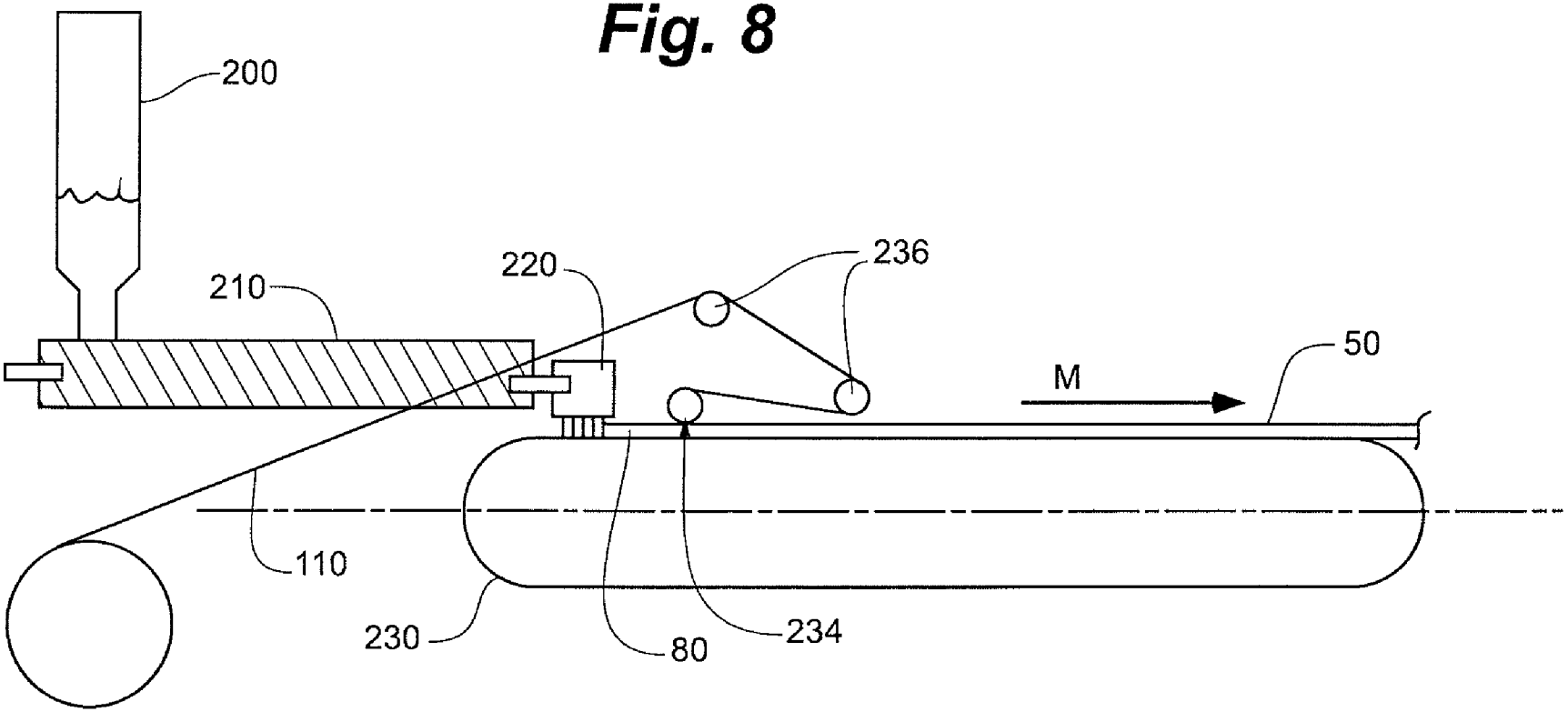
FIG. 8 shows a schematic process flow diagram of a method of manufacture in accordance with embodiments of the invention.

Referring to FIG. 8, in some embodiments the polymer used to make the voluminous core 80 can be conveyed to a hopper 200 above an extruder 210. The polymer can be heated to its melting point, extruded, and conveyed to an extrusion die (e.g., a spinnerette 220). The spinnerette 220 can include a plurality of holes (not shown) corresponding to the desired filament diameter size. The molten polymer can be extruded through the plurality of holes in the spinnerette to form filaments of polymer.

The spinnerette can be positioned above a moving profile belt 230, onto which the molten filaments can be deposited. The molten filaments form a three dimensional matrix of fused entangle filaments as they cool, thus taking the mirror image shape of the profile on the belt, described further below.

While the filaments are still in the molten phase, a backing layer 110 can be pressed onto the polymer at the plateaus of the profiles (e.g., with a press roll 234, after a series of optional direction rollers 236) to attach the backing layer to the matrix as the polymer matrix of the voluminous core 80 cools to form a solid matrix. The now formed voluminous core with backing layer attached can continue down the rotating oscillating profile belt in the direction of a matrix cutter and roll take-up (not shown in FIG. 8).

Figure 9:
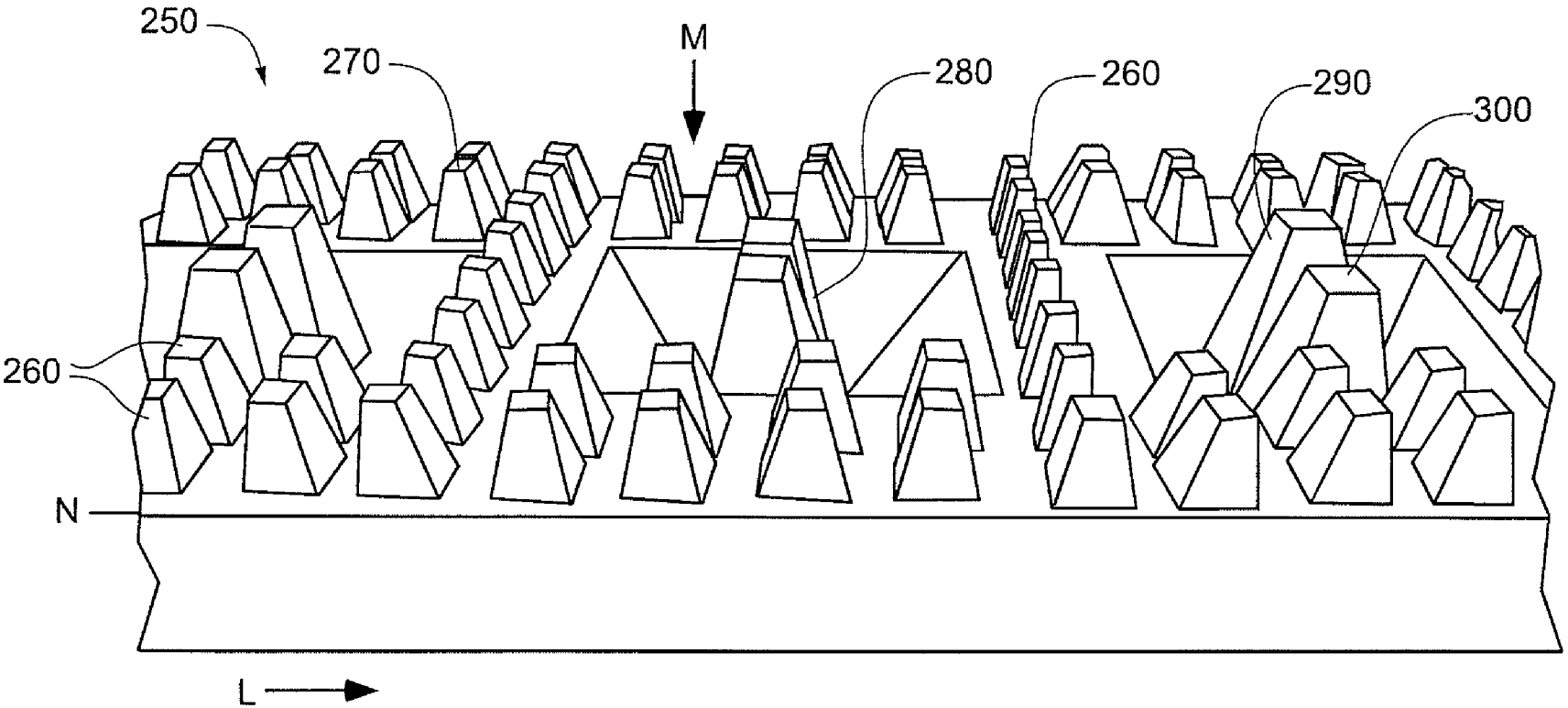
FIG. 9 shows a perspective view of a profile slat in accordance with embodiments of the invention.

The profile belt 230 may comprise any material that can withstand the molten polymer (e.g., silicone rubber) without substantial surface degradation. The belt may include a series of connected profile slats. A single profile slat 250 is shown in FIG. 9. In the embodiment shown in FIG. 9, each slat 250 includes two rows of relatively small feature formers 260 with a height of about ⅜ inch (about 0.95 cm) from a neutral axis N, a plateau top 270 of about 0.16 inches square (about 0.4 cm square) and spaced 0.5 inches (about 1.3 cm) center to center. Proceeding in the machine direction M (also depicted in FIG. 8), in the embodiment shown there is a cavity 280 with relatively large feature formers 290 with a total height of about 0.95 inches (about 2.4 cm), a height of about ⅜ inch (about 0.95 cm) from the neutral axis, a plateau top 300 of about 0.24 inches square (about 0.6 cm square), and spaced about 0.75 inches (about 1.9 cm) center to center. In some embodiments, in the cross-machine direction C the cavities 280 are separated by a row of relatively small feature formers 260 (the row proceeds in the machine direction). In the embodiment shown, and again proceeding in the machine direction M from the edge of the cavity 280, there are two more rows of relatively small feature formers 260. These profile slats may be joined to create a profile belt useful for providing desired features to the sound insulating layer. While a continuous profile belt is described herein, a profile roll with the desired profile shapes can also be utilized to form the voluminous core.

In some embodiments, an underlayment layer 60 can be applied to be in apposition to the backing layer 110 after the sound insulation layer 50 has been installed at a job site. Examples of suitable underlayment layers include underlayment layers comprising gypsum, such as floor underlayments by Maxxon Corporation, Hammel, Minn. The underlayment layer can be of any suitable thickness. In some embodiments, the underlayment layer has a thickness of at least 1 inch (about 2.54 cm). In certain embodiments, the underlayment layer has a thickness of about $9/16^{th}$ inch to about 2 inches (e.g., about 1.5 inches) (about 1.43 cm to about 5.1 cm (e.g., about 3.81 cm)).

Embodiments of the invention also include a method of installing a sound insulation layer 50 for a corrugated metal flooring system. The method can include the step of placing any of the embodiments of the sound insulation layer described herein in apposition to a corrugated deck, wherein the flute resting portion is placed on a flute of the corrugated deck and the trough resting portion is placed in a trough of the corrugated deck. Underlayment layers and finished floor products, as described above, may be installed over the sound insulation layer.

EXAMPLES

The following examples are presented for illustrative purposes and are not intended to limit the scope of the claims that follow.

Example 1

Preparation of a Sound Insulation Layer

Polymer chips of nylon 6 were conveyed to a hopper above an extruder. The nylon 6 had a relative viscosity (1% polymer solution in $H_2SO_4$ of 96% @20 deg C.) of 2.4 to 2.8, and was dried to 60 to 200 PPM water for optimum processing conditions. In Trial 1, virgin nylon 6 was used. In Trial 2, 40% recycled nylon 6 was used. The polymer chips were heated to approximately 270 degrees Celsius where they were melted, extruded and conveyed to a spinnerette. The spinnerette had 600 holes across an area of 1 meter wide by 6 cm deep. The hole diameter at the capillary was 350 microns. The molten polymer was thus extruded through the plurality of holes in the spinnerette to form filaments of nylon with a diameter of approximately 350 microns.

The spinnerette was positioned above a moving profile belt, onto which the molten filaments were deposited. The molten filaments formed a three dimensional matrix of fused entangle filaments as they cooled, thus taking the mirror image shape of the profile on the belt. The belt used to form the matrix was made of silicone rubber. The belt included 132 profile slats. Each profile slat was about 4 inches (about 10 cm) wide in the machine direction. Proceeding in the machine direction, each slat included two rows of relatively small feature formers with a height of about ⅜ inch (about 0.95 cm) from a neutral axis, a plateau top of about 0.16 inches square (about 0.4 cm square) and spaced 0.5 inches (about 1.3 cm) center to center. Again proceeding in the machine direction, there was a cavity with two relatively large feature formers with a total height of about 0.95 inches (about 2.4 cm), a height of about ⅜ inch (about 0.95 cm) from the neutral axis, a plateau top of about 0.24 inches square (about 0.6 cm square), and spaced about 0.75 inches (1.9 cm) center to center. In the cross-machine direction, the cavities were separated by a row of four relatively small feature formers with the same measurements as described above (the row proceeds in the machine direction). Again proceeding in the machine direction from the edge of the cavity, there were two rows of relatively small feature formers with the measurements described above. The surface rate of the belt was 22 feet per minute (about 6.7 meters per minute) with an oscillation frequency of 200 cycles per min. The amplitude was 1 cm.

While the filaments were still in the molten phase, a backing layer (SENW WBF-80 Nonwoven Laminate from Southeast Nonwovens, Inc.) was pressed onto the polymer at the plateaus of the profiles using a press roll, thus attaching the backing layer to the matrix of the voluminous core as the polymer matrix cooled to form a solid matrix. The now formed matrix with backing layer attached continued down the rotating oscillating profile belt in the direction of a matrix cutter and roll take-up.

The voluminous core shape was designed to match metal decking such that the top of the flute resting portion is positioned above the peak of the flute of the deck by ⅜ inch (0.95 cm). The top portion has the backing layer attached. At installation the sound insulation layer will be flat on top (backing layer side) and the backing layer will be positioned ⅜ inch (0.95 cm) above the high point of the metal deck while the underside of the voluminous core will generally fill the troughs of the lower portion of the metal deck. For both Trial 1 and Trial 2, 1200 linear feet (about 365 linear meters) of the matrix was made.

Example 2

Testing of Sound Insulation Layer Made in Accordance with Example 1

Ten 6.75 inch square (about 17.1 cm square) specimens of each sound insulation layer described in Example 1 were prepared and placed into a controlled-environment chamber at 21° C. and 60% relative humidity for 48 hours prior to testing. The samples were retrieved, and basis weight (in grams per square meter (g/sqm)) and caliper thickness were measured using standard laboratory practices. After the basis weight and thickness of each specimen was determined, each specimen was tested for compression resistance under a load (kilogram per square meter (kg/sqm)) using standard laboratory practices.

The results of the basis weight and thickness measurements are found in Table 1.

TABLE 1

Basis weight and caliper measurement

| | Trial 2 | | Trial 1 | | SENW WBF 80 | |
|---|---|---|---|---|---|---|
| | Weight g/sqm | Caliper cm | Weight g/sqm | Caliper cm | Weight g/sqm | Caliper cm |
| | 675.7 | 2.16 | 698.1 | 2.10 | 68.1 | 0.035 |
| | 704.5 | 2.18 | 659.4 | 2.07 | 69.5 | 0.024 |
| | 696.0 | 2.19 | 666.9 | 2.11 | 67.1 | 0.024 |
| | 678.4 | 2.19 | 661.8 | 2.05 | 76.9 | 0.038 |
| | 684.8 | 2.12 | 693.3 | 2.12 | 69.1 | 0.030 |
| | 683.5 | 2.17 | 655.3 | 2.08 | 71.5 | 0.031 |
| | 698.1 | 2.13 | 655.3 | 2.11 | 69.5 | 0.038 |
| | 698.7 | 2.17 | 679.1 | 2.11 | 79.6 | 0.036 |
| | 686.2 | 2.20 | 659.1 | 2.06 | 72.5 | 0.033 |
| | 676.4 | 2.16 | 680.8 | 2.08 | 66.4 | 0.031 |
| Average | 688.2 | 2.17 | 670.9 | 2.09 | 71.2 | 0.032 |
| Core | 617.0 | 2.13 | 599.7 | 2.06 | | |

Table 2 provides the sound insulation layer thickness at a series of loads. The values were normalized because the Trial 2 samples were thicker initially. The third column in the table is a linear interpolation using the factor 1.03.

TABLE 2

Thickness at various loads

| Load (kg/sqm) | Trial 2 (cm) | Trial 1 (cm) | Trial 1 Normalized (cm) |
|---|---|---|---|
| 244.1 | 1.94 | 1.85 | 1.91 |
| 488.2 | 1.83 | 1.75 | 1.81 |
| 976.4 | 1.52 | 1.51 | 1.56 |
| 1464.7 | 0.95 | 0.92 | 0.96 |
| 1952.9 | 0.84 | 0.77 | 0.80 |
| 2441.2 | 0.77 | 0.68 | 0.71 |
| 3661.8 | 0.65 | 0.55 | 0.57 |
| 4882.4 | 0.55 | 0.47 | 0.49 |

Example 3

Sound Control Characteristics

The Trial 2 sound insulation layer of Example 1 was tested for sound control in accordance with ASTM Standards E 90 (STC) and E 492 (IIC). Laboratory tests were run with a flooring system comprising 16 gauge metal C joists spaced 24 inches (60.96 cm) on center, ⅝ inch (about 1.59 cm) include Type C gypsum board ceiling on the underside of the joists, 9/16 inch (about 1.43 cm) 22 gauge galvanized corrugated steel decking on the topside of the joists, the sound insulation layer of Example 1 on top of the decking, and 1.5 inches (about 3.8 cm) of Maxxon DURA-CAP gypsum underlayment on top of the sound insulation layer. Several finished floor products were installed over the underlayment layer for the various tests. The flooring system achieved a STC of 57 dB in accordance with ASTM Standard E 90. The flooring system achieved an IIC rating of 51 with a ceramic tile finished floor, an IIC rating of 53 with a floating wood finished floor, and an IIC rating of 52 with a sheet vinyl finished floor in accordance with ASTM Standard E 492, showing that the flooring system meets the applicable IBC, UBC and local code standards.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations, which fall within the spirit and broad scope of the invention.

What is claimed is:

1. A sound insulation layer for a corrugated decking flooring system, comprising:

a backing layer; and a voluminous core attached to the backing layer, the voluminous core including alternating flute resting portions and trough resting portions, the flute resting portion adapted to rest on a flute of a corrugated deck and the trough resting portion adapted to rest in a trough of the corrugated deck, the flute resting portion having a thickness such that the backing layer rests at a position above a high point of the flute when the sound insulation layer is positioned on the corrugated deck, wherein the flute resting portion includes a plurality of relatively small recesses formed of fused entangled filaments and the trough resting portion includes a plurality of relatively large recesses formed of fused entangled filaments, the relatively small recesses and relatively large recesses each having plateau bottoms residing in a same plane.

2. The sound insulation layer for a corrugated decking flooring system of claim 1, wherein the corrugated decking comprises steel.

3. The sound insulation layer for a corrugated decking flooring system of claim 1, wherein the flutes are spaced about 2.5 inches (about 6.35 cm) from center to center and have a depth of about 9/16 inch (about 1.43 cm).

4. The sound insulation layer for a corrugated decking flooring system of claim 1, wherein the corrugated deck is supported by a joist.

5. The sound insulation layer for a corrugated decking flooring system of claim 4, wherein the joist comprises steel.

6. The sound insulation layer for a corrugated decking flooring system of claim 1, wherein the voluminous core comprises a plurality of fused entangled filaments.

7. The sound insulation layer for a corrugated decking flooring system of claim 1, wherein the voluminous core comprises a polymer.

8. The sound insulation layer for a corrugated decking flooring system of claim 1, wherein the voluminous core comprises nylon.

9. The sound insulation layer for a corrugated decking flooring system of claim 1, wherein the flute resting portion includes a plurality of fused entangled filaments having a first average diameter and the trough resting portion includes a plurality of fused entangled filaments having a second average diameter, the second average diameter being greater than the first average diameter.

10. The sound insulation layer for a corrugated decking flooring system of claim 1, wherein the flute resting portion includes a plurality of fused entangled filaments having a generally corrugated shape, the corrugations proceeding in a first direction, and the trough resting portion having a longitudinal axis, the longitudinal axis being generally normal to the first direction.

11. The sound insulation layer for a corrugated decking flooring system of claim 1, wherein one or more of the plurality of relatively large recesses of the trough resting portion are separated by relatively small recesses.

12. The sound insulation layer for a corrugated decking flooring system of claim 1, wherein the backing layer comprises a nonwoven fabric.

13. The sound insulation layer for a corrugated decking flooring system of claim 12, wherein the nonwoven fabric comprises polyester.

14. The sound insulation layer for a corrugated decking flooring system of claim 1, wherein the sound insulation layer comprises a voluminous core attached to a backing layer, the backing layer suitable for being in apposition to an underlayment layer.

15. The sound insulation layer for a corrugated decking flooring system of claim 14, wherein the underlayment layer comprises gypsum.

16. The sound insulation layer for a corrugated decking flooring system of claim 14, wherein the underlayment layer has a thickness of at least about 1 inch.

17. A method of making a sound insulation layer for a corrugated decking flooring system, the method comprising:

providing a backing layer; and attaching a voluminous core to the backing layer, the voluminous core including alternating flute resting portions and trough resting portions, the flute resting portion adapted to rest on a flute of a corrugated deck, and the trough resting portion adapted to rest in a trough of the corrugated deck, the flute resting portion having a thickness such that the backing layer rests at a position above a high point of the flute when the sound insulation layer is positioned on the corrugated deck, wherein the flute resting portion includes a plurality of relatively small recesses formed of fused entangled filaments and the trough resting portion includes a plurality of relatively large recesses formed of fused entangled filaments, the relatively small recesses and relatively large recesses each having plateau bottoms residing in a same plane.

18. A method of installing a sound insulation layer for a corrugated decking flooring system, the method comprising:

placing the sound insulation layer in apposition to a corrugated deck, the sound insulation layer having a backing layer and a voluminous core attached to the backing layer, the voluminous core including alternating flute resting portions and trough resting portions, wherein the flute resting portion is placed on a flute of the corrugated deck and the trough resting portion is placed in a trough of the corrugated deck, the flute resting portion having a thickness such that the backing layer rests at a position above a high point of the flute, wherein the flute resting portion includes a plurality of relatively small recesses formed of fused entangled filaments and the trough resting portion includes a plurality of relatively large recesses formed of fused entangled filaments, the relatively small recesses and relatively large recesses each having plateau bottoms residing in a same plane.

* * * * *